US005728646A

United States Patent [19]

Tominaga et al.

[11] Patent Number: 5,728,646

[45] Date of Patent: Mar. 17, 1998

[54] HEAT-SENSITIVE RECORDING MATERIAL

[75] Inventors: Nobuhide Tominaga; Keiji Oya, both of Saitama-ken, Japan

[73] Assignee: Asahi Denka Kogyo Kabushiki Kaisha, Tokyo, Japan

[21] Appl. No.: 744,251

[22] Filed: Nov. 5, 1996

[51] Int. Cl.[6] ..... B41M 5/30

[52] U.S. Cl. ..... 503/208; 503/209; 503/216; 503/225

[58] Field of Search ..... 437/150–152; 503/208, 209, 216, 225

[56] References Cited

U.S. PATENT DOCUMENTS

| | | | |
|---|---|---|---|
| 4,334,015 | 6/1982 | Yarian | 503/218 |

FOREIGN PATENT DOCUMENTS

| | | | |
|---|---|---|---|
| 56-155791 | 12/1981 | Japan | 503/209 |
| 62-156987 | 7/1987 | Japan | 503/209 |
| 62-238788 | 10/1987 | Japan | 503/209 |
| 03016788 | 1/1991 | Japan | 503/216 |
| 3-16788 | 1/1991 | Japan | 503/216 |
| 04371958 | 12/1992 | Japan | 430/138 |

*Primary Examiner*—Bruce H. Hess
*Attorney, Agent, or Firm*—Young & Thompson

[57] ABSTRACT

A heat-sensitive recording material, comprising a heat-sensitive recording layer containing at least one acid hydrazide compound represented by the following general formula (I):

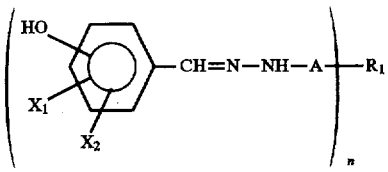

(I)

wherein $X_1$ and $X_2$ each independently represent a hydrogen atom, a hydroxyl group, a halogen atom or an alkyl group or alkoxy group having 1 to 10 carbon atoms, A represents —CO— or —$SO_2$—, n is 1 or 2, when n is 1, $R_1$ represents an alkyl group, an aryl group, a hydroxyaryl group, an alkoxyaryl group, or an alkylaryl group having 1 to 22 carbon atoms and when n is 2, $R_1$ represents an alkylene group or arylene group having 1 to 18 carbon atoms or a direct bond.

6 Claims, No Drawings

HEAT-SENSITIVE RECORDING MATERIAL

BACKGROUND OF THE INVENTION

1. [Field of the Invention]

The present invention relates to a heat-sensitive recording material improved in storage stability, and more particularly to a heat-sensitive recording material containing a specified acid hydrazide compound added thereto to thereby improve storage stability, such as resistance to heat, light, and oil.

2. [Description of Related Art]

Heat-sensitive recording materials are produced by applying a usually colorless or light-colored coupling substance and a developer which colors the coupling substance upon being heated together with a sensitizer, a binder, and other additives to the surface of a support, such as paper, synthetic paper, plastic film or sheet. When a heating element, such as a thermal head or hot pen, is brought in contact with the recording material in a recording device, the coupling substance reacts with the developer to develop a color, such as black, thereby forming a record. The above recording materials (heat-sensitive recording materials) are widely used not only as a recording material for copying books and documents but also as a recording paper used in instrumental recorders, as a recording material used in computers, telex devices, and machines for vending passenger tickets or the like, and as a recording material including prepaid cards, labels, etc., because, in comparison with other recording materials, they have such advantages that complicated treatments, such as development and fixing, can be dispensed with, the records can be obtained in a short period of time with the use of a relatively simple apparatus, the noise and the environmental pollution are only slight, and they are inexpensive.

With respect to the conventional heat-sensitive recording materials, those practically satisfactory from the viewpoint of initial coloring sensitivity are obtained by the use of an appropriate combination of a coupling substance (leuco dye), a developer which effects thermal coloring of the coupling substance, and an optionally employed sensitizer.

However, when the above heat-sensitive recording materials are exposed to sunlight or illuminating rays for a prolonged period of time, the printed area (colored area) fades or vanishes. When a printout of the above heat-sensitive recording materials from a facsimile, a word processor, a personal computer, or the like is allowed to stand still on a desk, the recorded images become unclear, thereby causing a problem on document storage.

Further, the conventional heat-sensitive recording materials have the drawbacks that not only they are poor in light resistance but also the storability is lowered when they are stored under conditions having high temperatures, when fingerprints are impressed thereon, or when the recording material is allowed to come in contact with oils, such as a plasticizer migrated, for example, from a desk mat made of polyvinyl chloride or the like. Therefore, there has been a strong demand for the improvement of the storage stability of the heat-sensitive recording material.

For example, Japanese Patent Laid-Open Nos. 156987/1987, 238788/1987, and 16788/1991, etc. suggest benzylideneamino compounds and Japanese Patent Laid-Open No. 155791/1981, etc. suggest phenylhydrazide derivatives, but when compounds actually described therein are used as a developer or a storage stabilizer of heat-sensitive recording materials, the storage stability is still unsatisfactory.

SUMMARY OF THE INVENTION

Therefore an object of the present invention is to provide a heat-sensitive recording material which causes less fading in the colored area and also less fogging in the non-image area even after storage under severe conditions, i.e., is excellent in storage stability.

The inventors have made intensive studies to find that the above object can be attained by a heat-sensitive recording material containing a specified acid hydrazide compound added thereto.

The present invention has been made on the basis of the above finding and provides a heat-sensitive recording material comprising a heat-sensitive recording layer containing at least one acid hydrazide compound represented by the following general formula (I):

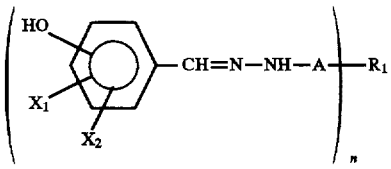

(I)

wherein $X_1$ and $X_2$ each independently represent a hydrogen atom, a hydroxyl group, a halogen atom, or an alkyl group or alkoxy group having 1 to 10 carbon atoms, A represents —CO— or —$SO_2$—, n is 1 or 2, when n is 1, $R_1$ represents an alkyl group, an aryl group, a hydroxyaryl group an alkoxyaryl group or an alkylaryl group having 1 to 22 carbon atoms, and when n is 2, $R_1$ represents an alkylene group or arylene group having 1 to 18 carbon atoms or a direct bond.

The heat-sensitive recording material of the present invention causes less fading in the colored area even after storage under severe conditions, i.e., has excellent storage stability.

DETAILED DESCRIPTION OF THE INVENTION

The heat-sensitive recording material of the present invention is described below in detail.

The acid hydrazide compound represented by the above general formula (I) for use in the present invention is used as a storage stabilizer and itself has developing capability to function as a developer.

In the above general formula (I), examples of the halogen atom represented by $X_1$ and $X_2$ includes a fluorine atom, a chlorine atom, an iodine atom, and a bromine atom, examples of the alkyl group having 1 to 10 carbon atoms includes such groups as methyl, ethyl, propyl, isopropyl, butyl, secondary butyl, tertiary butyl, isobutyl, amyl, tertiary amyl, hexyl, heptyl, octyl, 2-ethylhexyl, isooctyl, nonyl, and decyl, and examples of the alkoxy group includes alkoxy groups derived from these alkyl groups.

Examples of the alkyl group having 1 to 22 carbon atoms represented by $R_1$ when n is 1 includes such groups as methyl, ethyl, propyl, isopropyl, butyl, secondary butyl, tertiary butyl, isobutyl, amyl, tertiary amyl, hexyl, heptyl, octyl, 2-ethylhexyl, isooctyl, nonyl, decyl, undecyl, dodecyl, tridecyl, tetradecyl, hexadecyl, stearyl, and behenyl, and examples of the aryl group includes such groups as phenyl and naphthyl, which may be substituted by a hydroxyl group, by the above exemplified alkyl group having 1 to 10 carbon atoms, or by an alkoxy group derived from said alkyl group. Examples of the alkylene group having 1 to 18 carbon atoms represented by $R_1$ when n is 2 includes such groups as methylene, ethylene, propylene, butylene, pentylene, hexylene, heptylene, octylene, nonylene, decylene, undecylene, dodecylene, tridecylene, tetradecylene, pentadecylene, hexadecylene, heptadecylene, and octadecylene, and examples of the arylene group includes such groups as phenylene and naphthylene, which may be substituted by a hydroxyl group, by the above exemplified alkyl group having 1 to 10 carbon atoms, or by an alkoxy group derived from said alkyl group.

Therefore, specific typical examples of the acid hydrazide compound represented by the above general formula (I) includes the following compounds Nos. 1 to 19:

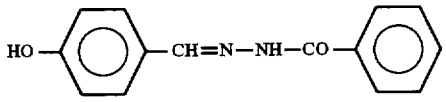

Compound No. 1

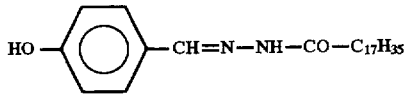

Compound No. 2

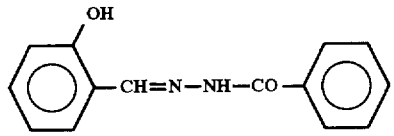

Compound No. 3

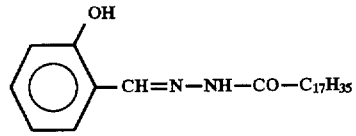

Compound No. 4

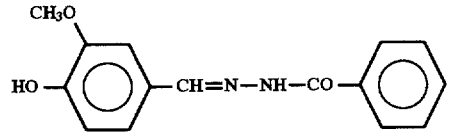

Compound No. 5

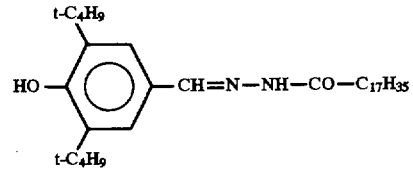

Compound No. 6

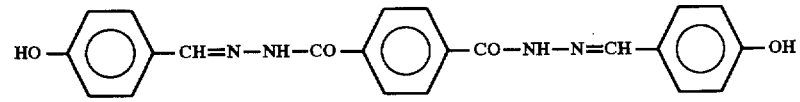

Compound No. 7

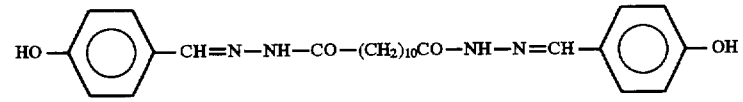

Compound No. 8

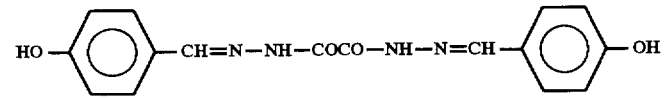

Compound No. 9

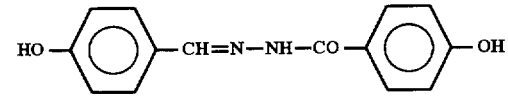

Compound No. 10

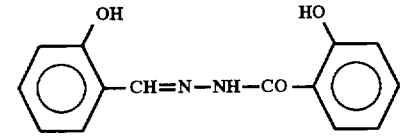

Compound No. 11

-continued

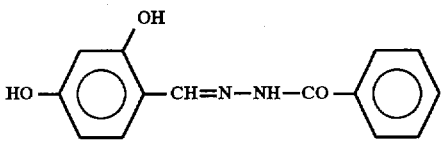

Compound No. 12

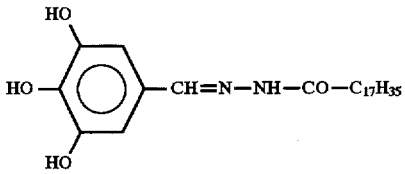

Compound No. 13

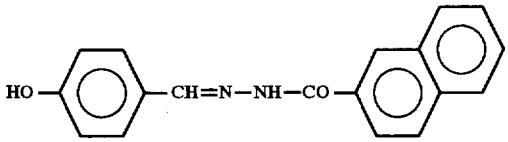

Compound No. 14

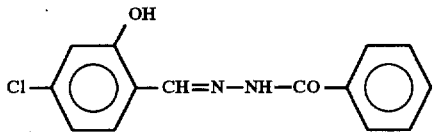

Compound No. 15

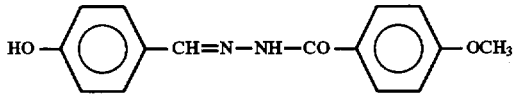

Compound No. 16

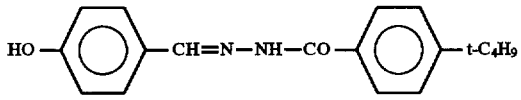

Compound No. 17

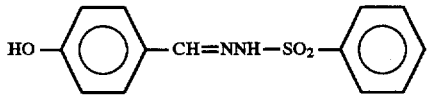

Compound No. 18

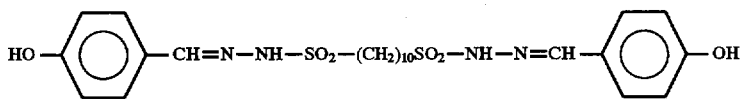

Compound No. 19

The acid hydrazide compound represented by the above general formula (I) can be easily prepared, for example, by reacting a benzaldehyde derivative with an acid hydrazide derivative in a usual manner.

SYNTHETIC EXAMPLE 1

(Preparation of Compound No. 1)

54.5 g of benzoic acid hydrazide, 51.3 g of 4-hydroxybenzanilide, and 200 ml of ethanol were charged and dissolved completely at room temperature and the solution was heated to 60° C., followed by stirring for 2 hours. Then the reaction mixture was cooled to 30° C. and resulting precipitated white crystals were filtered and taken out.

The obtained white crystals had a melting point of 241° C., and the results of the infrared spectrometry (IR) and elemental analysis are given below, which identified the intended product.

IR ($cm^{-1}$): 3250, 3200, 3020, 1600, 1540, 1500, 1360, 1160, 1050, 830, 685

Elemental analysis: C/N/O=69.86/11.43/13.45

Although the content of the acid hydrazide compound represented by the above general formula (I) varies depending on the demanded performance and suitability for recording, and the kinds and amounts of the below-described coupling dyes and other additives, such as another developer and a sensitizer employed in combination therewith and hence is not particularly limited, it usually ranges from 0.01 to 10 parts by weight, and preferably from 0.1 to 5 parts by weight, per part by weight of the coupling dye. When the above content is less than 0.01 part by weight, the effect on the improvement of the storage stability is poor while when the above content is more than 10 parts by weight, the above effect is no longer enhanced, leading to the waste thereof.

The heat-sensitive recording material of the present invention comprises a heat-sensitive recording layer and a support. The heat-sensitive recording layer contains at least one acid hydrazide compound represented by the above general formula (I). The heat-sensitive recording layer is formed from the acid hydrazide compound represented by the above general formula (I) and a coupling substance optionally together with another developer, a sensitizer, a known storage stabilizer, etc.

The above coupling substances are generally colorless or light-colored and various dyes (coupling dyes) are known to be used as the coupling substances. The dyes are not particularly limited so far as they are usually used for producing ordinary heat-sensitive recording materials, such as heat-sensitive recording paper.

Specific examples of the above coupling dyes include:

(1) triarylmethane compounds, such as 3,3-bis(p-dimethyl-aminophenyl)-6-dimethyl-amino-phthalide, 3-(p-dimethyl-amino-phenyl)-3-(2-phenyl-3-indolyl)phthalide, 3-(p-dimethylaminophenyl)-3-(1,2-dimethyl-3-indolyl) phthalide, 3,3-bis(9-ethyl-3-carbazolyl)-5-dimethyl-aminophthalide, 3,3-bis(2-phenyl-3-indolyl)-5-dimethyl-amino-phthalide, and tris(4-dimethyl-aminophenyl) methane;

(2) diphenylmethane compounds, such as 4,4-bis-(dimethylamino)benzhydrine benzyl ether and N-2,4,5-tri-chloro-phenyl-leuco-auramine;

(3) xanthene compounds, such as Rhodamine-β-anilinolactam, 3-(N-methyl-N-cyclohexylamino)-6-methyl-7-anilino-fluoran, 3-(N-cyclo-hexyl-amino)-6-chloro-fluoran, 3-diethyl-amino-fluoran, 3-diethylamino-7-octyl-amino-fluoran, 3-diethyl-amino-7-(2-chloro-anilino)-fluoran, 3-diethyl-amino-6-methyl-7-anilino-fluoran, 3-diethyl-amino-6-methyl-7-(2,4-dimethyl-anilino)-fluoran, 3-diethyl-amino-7-dibenzyl-amino-fluoran, 3-diethyl-amino-6-chloro-7-(β-ethoxy-ethyl-amino)fluoran, 3-diethyl-amino-6-chloro-7-(γ-chloro-propyl-amino) fluoran, 2-diethylamino-7-(3-tri-fluoro-methyl-anilino) fluoran, 3-(N-ethyl-N-isoamylamino)-6-methyl-7-anilino-fluoran, 3-(N-ethyl-N-ethoxy-ethyl-amino)-6-methyl-7-anilino-fluoran, 3-tetra-hydropyrrolyl-6-methyl-7-anilino-fluoran, 3-(N-ethyl-N-tetra-hydrofrufurylamino)-6-methyl-7-anilino-fluoran, 3-(N-ethyl-N-tolylamino)-7-(N-methylanlino)fluoran, 3-(N-ethyl-N-tolylamino)-7-methylfluoran, 3-dibutylamino-6-methyl-7-anilino-fluoran, 3-dibutyl-amino-7-(2-chloro-anilino)fluoran, 3-dipentylamino-6-methyl-7-anilinofluoran, 3-piperidino-6-methyl-7-anilinofluoran, and 3-(4-anilino)anilino-6-methyl-7-chlorofluoran;

(4) thiazine compounds, such as benzoyl leuco methylene blue and p-nitrobenzoyl leuco methylene blue;

(5) spiro compounds, such as 3-methyl-spirodinaphthopyran, 3-ethylspirodinaphthopyran, 3-benzyl-spirodinaphthopyran, and 3-methylnaphtho-(3-methoxybenzo)spiropyran; and (6) other compounds, such as 3,5',6-tris-(dimethylamino) -spiro[9H-fluorene-9,1'(3'H)-iso-benzofuran]-3'-one, 1,1-bis [2-(4-dimethylaminophenyl)-2-(4-methoxyphenyl)ethenyl]-4,5,6,7-tetra-chloro(3H)-iso-benzo-furan-3-one, and 2-(3-methoxy-4-dodecyl-oxy-styryl)-quinoline, which dyes (1) to (6) may be used singly or as a combination of two or more.

As described above, the acid hydrazide compound represented by the above general formula (I) for use in the present invention is effective as a developer excellent in storage stability and therefore may be used alone. However, when the coloring sensitivity is needed to be increased further, any other known developer (developing substance), such as a phenol developer, an organic carboxylic acid developer, or a metal salt developer, can be used additionally, which can reduce the content of the above acid hydrazide compound. Further, the above acid hydrazide compound for use in the present invention is highly effective in improving the stability of the recording material during storage, so that, even when other developer is used in a large quantity, the stability of the recording material during storage can be improved.

Examples of the above other developer include phenol developers, such as p-octylphenol, p-tert-butyl-phenol p-phenyl-phenol, p-hydroxy-aceto-phenone, α-naphthol, β-naphthol, p-tert-octyl-catechol, 2,2'-dihydroxy-bi-phenyl, bisphenol-A, 1,1-bis(p-hydroxy-phenyl)butane, 2,2-bis(4-hydroxy-phenyl)-heptane, 2,2-bis(3-methyl-4-hydroxy-phenyl)propane, 2,2-bis(3,5-dimethyl-4-hydroxy-phenyl) propane, 2,2-bis(3,5-dichloro-4-hydroxy-phenyl)propane, bis(4-hydorxyphenyl) sulfone, bis-(3-allyl-4-hydroxy-phenyl) sulfone, bis-(3,4-dihydroxyphenyl) sulfone, 2,4'-dihydroxyphenyl sulfone, 1,1-bis(4-hydroxy-phenyl)cyclo-hexane, bis-(4-hydroxy-phenyl)-ether, bis-[2-(4-hydroxy-phenylthio)ethoxy]-methane, 4-(4-iso-propoxy-benzene-sulfonyl)-phenol, dimethyl 4-hydroxy-phthalate, butyl bis-(4-hydroxy-phenyl)acetate, benzyl p-hydroxybenzoate, 3,5-di-tert-butylsalicylic acid, 2,4-dihydroxybenzanilide, 2,4-dihydroxy-2'-methoxybenzanilide, 2,4-dihydroxy-2',4'-dimethylbenzanilide, and 2,4-dihydroxy-2'-methoxy-5'-methylbenzanilide, resorcinol developers, organic carboxylic acid developers, such as benzoic acid developers, and metal salt developers, such as zinc salicylate developers. Among these, particularly phenol developers are preferably used.

The usage of the above other developers is usually 0.1 to 10 parts by weight, and preferably 0.2 to 5 parts by weight, per part by weight of the coupling dye. If the usage of the above other developers is less than 0.1 part by weight per part by weight of the coupling dye, the coloring sensitivity is unsatisfactory while if the usage is over 10 parts by weight, the effect is no longer enhanced, leading to the waste thereof.

In order to further enhance the coloring sensitivity of the heat-sensitive recording material of the present invention, to the heat-sensitive recording material of the present invention can be added various sensitizers, for example, metal salts of organic acids, such as zinc acetate, zinc octylate, zinc laurate, zinc stearate, zinc oleate, zinc behenate, zinc benzoate, zinc dodecylsalicylate, calcium stearate, magnesium stearate, and aluminum stearate; amide compounds, such as stearamide, stearic methylolamide, stearoylurea, acetanilide, acetotoluidide, benzoic stearylamide, ethylene-bisstearamide, hexa-methylene-bisoctylamide, acetoacetic anilide, o-chloroacetoacetic anilide, acetoacetic toluidide, and acetoacetic xylide; 1,2-bis-(3,4-dimethylphenyl)ethane, m-terphenyl, 1,2-diphenoxy-ethane, 1,2-bis-(3-methyl-phenoxy)-ethane, p-benzyl-biphenyl, p-benzyloxybiphenyl, diphenyl carbonate, bis(4-methylphenyl) carbonate, dibenzyl oxalate, bis(4-methylbenzyl) oxalate, phenyl 1-hydroxy-2-naphthalenecarboxylate, 3-hydroxy-2-naphthalenecarboxylic anilide, benzyl-1-hydroxy-2-naphthalene-carboxylate, phenyl 3-hydroxy-2-naphthalene-carboxylate, methylene dibenzoate, 1,4-bis(2-vinyloxyethoxy)benzene, 2-benzyloxynaphthalene, benzyl 4-benzyloxybenzoate, dimethyl phthalate, dibenzyl terephthalate, dibenzoylmethane, and 4-methylphenoxy-p-biphenyl, which are used usually in an amount of 0.1 to 10 parts by weight per part by weight of the coupling dye.

When the heat-sensitive recording material of the present invention must have an especially high storage stability, any of other storage stabilizers can be used according to necessity in combination with the acid hydrazide compound represented by the above general formula (I).

Examples of such other storage stabilizerst include hindered phenol compounds, such as 1,1,3-tris(2-methyl-4-hydroxy-5-tertbutylphenyl)butane,1,1,3-tris(2-methyl-4-hydroxy-5-cyclohexylphenyl)butane, 4,4'-butylidenebis(2-tert-butyl-5-methylphenol), 4,4'-thiobis(2-tert-5-methyl-phenol), 2,2'-thiobis(6-tert-butyl-4-methylphenol), and 2,2'-methylenebis(6-tert-butyl-4-methylphenol); and 4-benzyloxy-4'-(2-methyl-glycidyl-oxy)diphenyl sulfone, and sodium 2,2'-methylene-bis(4,6-di-tert-butyl-phenyl) phosphate. These storage stabilizers are generally used in an amount of 0.1 to 10 parts by weight per part by weight of the coupling dye.

The heat-sensitive recording material of the present invention can be obtained, for example, in the following manner.

The acid hydrazide compound represented by the above general formula (I) for use in the present invention and the coupling dye optionally together with the other developer, the sensitizer, and the other storage stabilizer are usually finely ground with a grinding machine, such as a ball mill, an attritor, or a sand grinder, or with a suitable emulsifier. Further, various additives as required are added, thereby obtaining a coating fluid. The coating fluid is applied to paper or any of various films, so that the desired heat-sensitive recording material of the present invention can be obtained.

The above coating fluid usually contains a binder, such as polyvinyl alcohol, hydroxyethylcellulose, methylcellulose, polyvinylpyrrolidone, polyacrylamide, starch, styrene/maleic anhydride copolymer, vinyl acetate/maleic anhydride copolymer, styrene/butadiene copolymer, or a modification of any of them and a filler, such as kaolin, silica, diatomaceous earth, talc, titanium dioxide, calcium carbonate, magnesium carbonate, aluminum hydroxide, or melamine. Further, a metallic soap, an amide, a wax, a light stabilizer, a waterproofing agent, a dispersant, an antifoaming agent, and the like can be added to the coating fluid according to necessity.

The heat-sensitive recording material of the present invention can be used for facsimile paper, printer paper, labels, price tags, tickets, and other various applications in which conventional heat-sensitive recording materials are used.

The present invention will be described in greater detail with reference to the following Examples. The Examples, however, by no means limit the present invention.

EXAMPLE 1

20 g of 3-(N,N-dibutylamino)-6-methyl-7-anilinofluoran and 100 g of a 10% aqueous polyvinyl alcohol solution were sufficiently milled by means of a ball mill, thereby obtaining a dispersion A.

20 g of bisphenol A and 100 g of a 10% aqueous polyvinyl alcohol solution were sufficiently milled by means of a ball mill, thereby obtaining a dispersion B.

20 g of 1,2-bis(m-cresoxy)ethane and 100 g of a 10% aqueous polyvinyl alcohol solution were sufficiently milled by means of a ball mill, thereby obtaining a dispersion C.

20 g of each sample compound (see Table 1 below) and 100 g of a 10% aqueous polyvinyl alcohol solution were sufficiently milled by means of a ball mill, thereby obtaining a dispersion D.

20 g of zinc stearate and 100 g of a 10% aqueous polyvinyl alcohol solution were sufficiently milled by means of a ball mill, thereby obtaining a dispersion E.

20 g of silicon dioxide and 100 g of a 10% aqueous polyvinyl alcohol solution were sufficiently milled by means of a ball mill, thereby obtaining a dispersion F.

The above dispersions A, B, C, D, E, and F were mixed in a weight ratio of 1:2:2:0.2:0.3:1.3. 50 g of calcium carbonate was added to 200 g of the resulting liquid mixture and was sufficiently dispersed therein, thereby obtaining a coating fluid. This coating fluid was applied to a paper support of 50 g/m$^2$ in basis weight to form a layer having a thickness of 32 μm, which was dried to thereby obtain a heat-sensitive recording material.

Printing was effected on the obtained heat-sensitive recording material by the use of a thermal printer (TH-PMD manufactured by Ohkura Electric Co., Ltd.) with its pulse width being fixed at 0.8 msec. The color density (initial density) of the recorded image was measured by the use of a Macbeth densitometer (model RD-933 manufactured by Macbeth Co.).

Then the colored heat-sensitive recording material was held at 60° C. under a dry condition for 24 hours and the change in the density of the colored area was measured to thereby evaluate the resistance to heat during storage.

Further, the colored heat-sensitive recording material was placed in a carbon arc fadeometer and irradiated for 6 hours. Thereafter the density of the printed area was measured to thereby evaluate the resistance to light during storage.

Still further, the colored heat-sensitive recording material was stamped with dioctyl phthalate and held at 40° C. under a dry condition for 24 hours. Thereafter, the density of the printed area was measured to thereby evaluate the resistance to oil during storage.

The results are given in Table 1 below.

TABLE 1

| No. | Sample compound | Initial density | Storage stability: resistance to heat | Storage stability: resistance to light | Storage stability: resistance to oil |
|---|---|---|---|---|---|
| Comparative Example | | | | | |
| 1-1 | none | 1.30 | 0.91 | 1.02 | 0.71 |
| 1-2 | comparative compound 1 | 1.30 | 0.93 | 0.98 | 0.69 |
| 1-3 | comparative compound 2 | 1.32 | 1.10 | 1.13 | 0.83 |
| 1-4 | comparative compound 3 | 1.31 | 1.13 | 1.10 | 0.80 |
| Example | | | | | |
| 1-1 | compound No. 1 | 1.35 | 1.24 | 1.32 | 1.17 |
| 1-2 | compound No. 2 | 1.33 | 1.19 | 1.29 | 1.15 |
| 1-3 | compound No. 3 | 1.34 | 1.20 | 1.28 | 1.12 |
| 1-4 | compound No. 5 | 1.36 | 1.26 | 1.33 | 1.20 |
| 1-5 | compound No. 8 | 1.32 | 1.21 | 1.30 | 1.16 |
| 1-6 | compound No. 18 | 1.31 | 1.19 | 1.29 | 1.18 |
| 1-7 | compound No. 19 | 1.30 | 1.18 | 1.29 | 1.19 |

In the table, compounds Nos. 1 to 19 are compounds mentioned above and comparative compounds 1 to 3 are the following compounds (the same being applied hereinafter).

Comparative compound 1 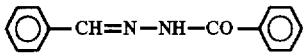

Comparative compound 2 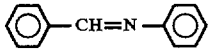

Comparative compound 3 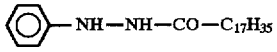

EXAMPLE 2

20 g of 3-(N-ethyl-N-isoamylamino)-6-methyl-7-anilinofluoran and 100 g of a 10% aqueous polyvinyl alcohol solution were sufficiently milled by means of a ball mill, thereby obtaining a dispersion A.

20 g of bisphenol A and 100 g of a 10% aqueous polyvinyl alcohol solution were sufficiently milled by means of a ball mill, thereby obtaining a dispersion B.

20 g of o-chloroacetoacetoanilide and 100 g of a 10% aqueous polyvinyl alcohol solution were sufficiently milled by means of a ball mill, thereby obtaining a dispersion C.

20 g of each sample compound (see Table 2 below) and 100 g of a 10% aqueous polyvinyl alcohol solution were sufficiently milled by means of a ball mill, thereby obtaining a dispersion D.

20 g of zinc stearate and 100 g of a 10% aqueous polyvinyl alcohol solution were sufficiently milled by means of a ball mill, thereby obtaining a dispersion E.

20 g of silicon dioxide and 100 g of a 10% aqueous polyvinyl alcohol solution were sufficiently milled by means of a ball mill, thereby obtaining a dispersion F.

The above dispersions A, B, C, D, E, and F were mixed and well dispersed in a weight ratio of 1:2:2:0.2:0.3:1.3. The resulting coating fluid was applied to a paper support of 50 g/m$^2$ in basis weight to form a layer having a thickness of 32 μm, which was dried to thereby obtain a heat-sensitive recording material.

Using the obtained heat-sensitive recording material, the same tests as made in Example 1 were carried out. The results are shown in Table 2 below.

TABLE 2

| No. | Sample compound | Initial density | Storage stability: resistance to heat | Storage stability: resistance to light | Storage stability: resistance to oil |
|---|---|---|---|---|---|
| Comparative Example | | | | | |
| 2-1 | none | 1.30 | 0.93 | 1.10 | 0.87 |
| 2-2 | comparative compound 1 | 1.31 | 0.95 | 1.08 | 0.96 |
| 2-3 | comparative compound 2 | 1.34 | 1.12 | 1.13 | 0.91 |
| 2-4 | comparative compound 3 | 1.32 | 1.13 | 1.05 | 0.95 |
| Example | | | | | |
| 2-1 | compound No. 1 | 1.35 | 1.26 | 1.23 | 1.26 |
| 2-2 | compound No. 2 | 1.34 | 1.21 | 1.20 | 1.21 |
| 2-3 | compound No. 3 | 1.36 | 1.22 | 1.21 | 1.23 |
| 2-4 | compound No. 5 | 1.34 | 1.27 | 1.24 | 1.28 |
| 2-5 | compound No. 8 | 1.37 | 1.25 | 1.25 | 1.22 |
| 2-6 | compound No. 18 | 1.34 | 1.22 | 1.19 | 1.21 |
| 2-7 | compound No. 19 | 1.36 | 1.23 | 1.20 | 1.23 |

EXAMPLE 3

20 g of 3-(N,N-dibutylamino)-6-methyl-7-anilinofluoran and 100 g of a 10% aqueous polyvinyl alcohol solution were sufficiently milled by means of a ball mill, thereby obtaining a dispersion A.

20 g of each sample compound (see Table 3 below) and 100 g of a 10% aqueous polyvinyl alcohol solution were sufficiently milled by means of a ball mill, thereby obtaining a dispersion B.

20 g of 1,2-bis(3,4-dimethylphenyl)ethane and 100 g of a 10% aqueous polyvinyl alcohol solution were sufficiently milled by means of a ball mill, thereby obtaining a dispersion C.

The above dispersions A, B, and C were mixed in a weight ratio of 1:2:2. 50 g of calcium carbonate was added to 200 g of the resulting liquid mixture and was sufficiently dispersed therein, thereby obtaining a coating fluid. This coating fluid was applied to a paper support of 50 g/m$^2$ in basis weight to form a layer having a thickness of 32 μm, which was dried to thereby obtain a heat-sensitive recording material.

Printing was effected on the obtained heat-sensitive recording material by the use of a thermal printer (TH-PMD manufactured by Ohkura Electric Co., Ltd.) with its pulse width being fixed at 1.0 msec. The color density (initial density) of the recorded image was measured by the use of a Macbeth densitometer (model RD-933 manufactured by Macbeth Co.).

The resistance to light during storage and the resistance to oil during storage under the same deterioration conditions as in Example 1 were evaluated. The results are shown in Table 3 below,

TABLE 3

| No. | Sample compound | Initial density | Storage stability: resistance to light | Storage stability: resistance to oil |
|---|---|---|---|---|
| Comparative Example | | | | |
| 3-1 | Comparative compound 2 | 1.05 | 0.83 | 0.35 |
| Example | | | | |
| 3-1 | compound No. 1 | 1.16 | 1.06 | 1.02 |
| 3-2 | compound No. 2 | 1.13 | 1.08 | 1.01 |
| 3-3 | compound No. 3 | 1.15 | 1.11 | 1.08 |

The results of the above Tables 1, 2, and 3 demonstrate the following.

In the cases wherein hydrazide derivatives not represented by the above general formula (I) or Schiff bases are used as developers (Comparative Examples 1-2 to 1-4, 2-2 to 2-4, and 3-1, the storage stability, such as the resistance to heat, light, and oil, is not satisfactory at all, and an additional effect by the use of other developers is scarcely observed.

In contrast, in the cases wherein acid hydrazide compounds represented by the above general formula (I) according to the present invention are used as developers (Examples 1-1 to 1-7, 2-1 to 2-7, and 3-1 to 3-3), excellent storability is exhibited, and particularly when they are used in combination with developers excellent in initial coloring sensitivity, not only the initial coloring sensitivity is excellent but also the storability is remarkably excellent.

What is claimed is:

1. A heat-sensitive recording material, comprising a heat-sensitive recording layer containing at least one acid hydrazide compound represented by the following general formula (I):

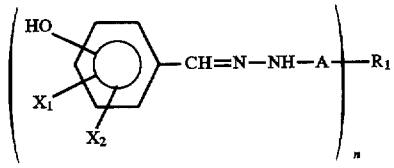

(I)

wherein $X_1$ and $X_2$ each independently represent a hydrogen atom, a hydroxyl group, a halogen atom, or an alkyl group or alkoxy group having 1 to 10 carbon atoms, A represents —CO— or —$SO_2$—, n is 1 or 2, when n is 1, $R_1$ represents an alkyl group, an aryl group, a hydroxyaryl group, an alkoxyaryl group, or an alkylaryl group having 1 to 22 carbon atoms, and when n is 2, $R_1$ represents an alkylene group or arylene group having 1 to 18 carbon atoms or a direct bond, said heat-sensitive recording layer further containing a phenol developer.

2. The heat-sensitive recording material as claimed in claim 1, wherein said heat-sensitive recording layer further contains a sensitizer.

3. The heat-sensitive recording material as claimed in claim 1, wherein said acid hydrazide compound is a compound represented by the general formula (I) wherein A is —CO— (a carbonyl group).

4. The heat-sensitive recording material as claimed in claim 1, wherein said acid hydrazide compound is a compound represented by the general formula (I) wherein n is 1.

5. The heat-sensitive recording material as claimed in claim 1, wherein said acid hydrazide compound is a compound represented by the general formula (I) wherein $R_1$ represents a hydroxyaryl group.

6. The heat-sensitive recording material as claimed in claim 1, wherein said acid hydrazide compound is N-salicyloyl-N'-salicylidenehydrazine.

* * * * *